US009234716B2

(12) United States Patent
Feddersen

(10) Patent No.: US 9,234,716 B2
(45) Date of Patent: Jan. 12, 2016

(54) GUN BARREL RIFLING

(71) Applicant: Frederick J. Feddersen, Loudon, TN (US)

(72) Inventor: Frederick J. Feddersen, Loudon, TN (US)

(73) Assignee: F. J. Feddersen, Inc.

( * ) Notice: Subject to any disclaimer, the term of this patent is extended or adjusted under 35 U.S.C. 154(b) by 0 days.

(21) Appl. No.: 13/694,264

(22) Filed: Nov. 14, 2012

(65) Prior Publication Data

US 2014/0150320 A1 Jun. 5, 2014

Related U.S. Application Data

(60) Provisional application No. 61/629,191, filed on Nov. 15, 2011.

(51) Int. Cl.
*F41A 21/18* (2006.01)

(52) U.S. Cl.
CPC ..... *F41A 21/18* (2013.01)

(58) Field of Classification Search
CPC ..... F41A 21/00; F41A 21/16; F41A 21/18; B21C 37/152
USPC ..... 42/78, 76.01, 76.1; 89/14.7, 14.05
See application file for complete search history.

(56) References Cited

U.S. PATENT DOCUMENTS

| | | | | |
|---|---|---|---|---|
| 16,377 | A | 1/1857 | Dimick | |
| 73,447 | A | 1/1868 | Hotchkiss | |
| 105,736 | A * | 7/1870 | Stimers | 42/78 |
| 119,846 | A | 10/1871 | Henry | |
| 128,446 | A | 6/1872 | Winchester | |
| 300,515 | A | 6/1884 | Schneider | |
| 329,303 | A | 10/1885 | Fosbery | |
| 835,482 | A | 11/1906 | Vulpius | |
| 840,085 | A * | 1/1907 | Mulock | 42/78 |
| 1,230,712 | A | 6/1917 | Holter | |
| 1,275,028 | A | 8/1918 | Holter | |
| 1,355,421 | A | 10/1920 | Pedersen | |
| 2,089,219 | A | 8/1937 | Moore | |
| 2,967,369 | A | 1/1961 | Musser | |
| 3,100,358 | A | 8/1963 | Robinson, Jr. | |
| 3,562,945 | A | 2/1971 | Mikola | |
| 3,616,562 | A | 11/1971 | Burgsmuller | |
| 3,643,364 | A | 2/1972 | Koch | |
| 3,780,465 | A * | 12/1973 | Polcha | 42/78 |
| 4,308,681 | A | 1/1982 | Gorman | |
| 4,437,251 | A | 3/1984 | Gorman | |
| 4,664,664 | A | 5/1987 | Drake, Jr. | |
| 4,677,897 | A | 7/1987 | Barrett | |
| 4,932,148 | A | 6/1990 | Barrett | |
| 6,170,187 | B1 | 1/2001 | Herrmann et al. | |
| 2013/0239451 | A1 * | 9/2013 | Glock | 42/78 |

FOREIGN PATENT DOCUMENTS

| | | | |
|---|---|---|---|
| DE | 102012017637 A1 * | 3/2013 | F41A 21/00 |
| GB | 1 409 331 | 10/1975 | |
| WO | WO 97/45690 A1 | 12/1997 | |

* cited by examiner

*Primary Examiner* — Jonathan C Weber

(74) *Attorney, Agent, or Firm* — Breiner & Breiner, L.L.C.

(57) ABSTRACT

The present invention relates to rifling of a gun barrel to provide grooves and bores in the gun barrel separated by a single edge area and a polygonal area.

11 Claims, 6 Drawing Sheets

GUN BARREL RIFLING

RELATED APPLICATION

This application claims the benefit of U.S. Provisional Application No. 61/629,191, filed Nov. 15, 2011.

FIELD OF THE INVENTION

The present invention relates to rifling of gun barrels. More specifically, the present invention relates to rifling of gun barrels to provide rifling having a single edge area and a polygonal area separating the grooves and bore. The invention provides for more accurate travel of a bullet, including 22 caliber lead bullets.

BACKGROUND OF THE INVENTION

Rifling of gun barrels is well known in the art. Gun barrels are rifled using three known techniques namely cut rifling, button rifling and hammer forge rifling. The cross-section of the rifling may generally be described as conventional rifling providing for a cross-sectional gear shaped configuration or polygonal rifling providing for a polygonal configuration. The present invention relates to rifling having a combination of standard rifling and polygonal rifling as described hereafter.

The prior art rifling while useful has various shortcomings, including deformation of the bullet which causes the center of gravity of the bullet to move off center and the bullet may not travel as straight as a bullet with a center of gravity more on center. Accordingly, improvement to barrel rifling is desirable to provide for more accurate tracking of bullets. The rifling techniques of the present invention provide such improvement.

SUMMARY OF THE INVENTION

A primary object of the present invention is to provide an improved rifling for a gun barrel having a single edge area and a polygonal area separating the grooves and bore. The invention allows the bullet to fly straighter and track more accurately.

The rifling of the present invention precludes any substantial deformation of the bullet with minimal engraving and in particular in 22 caliber lead bullets. The rifling, therefore, allows the bullet to move more symmetrically along the barrel and, therefore, the bullet will track more accurately to the target.

The rifling of the present invention provides additional improvement over the prior art as it includes a single edge area and a polygonal area separating the grooves and bore. Accordingly, the rifling includes a bore area, a groove area, a land area, i.e. the single edge area, and a polygonal area, e.g., a flat area. The lead projectile, and in particular a 22 caliber lead bullet, follows the single edge making the bullet twist and which makes the bullet more symmetrical when passing through and leaving the gun barrel.

These primary and other objects of the invention will be apparent from the following description of the preferred embodiments of the invention and from the accompanying drawings.

BRIEF DESCRIPTION OF THE DRAWINGS

Referring to the drawings.

DETAILED DESCRIPTION OF THE PREFERRED EMBODIMENTS

The present invention is disclosed in FIGS. 1-12, FIGS. 1-6 illustrate one preferred embodiment of the invention and FIGS. 7-12 illustrate a second preferred embodiment. The invention relates to rifling of a gun barrel to provide grooves in the bore of the gun barrel wherein the grooves are separated by a single edge area and a polygonal area. The polygonal area is preferably a flat area but is not limited thereto.

The rifling of the present invention may be made by known rifling techniques including cut rifling, button rifling and hammer forge rifling. In the preferred embodiments, the gun barrel is rifled using button rifling wherein the button is pulled through the barrel to create the rifling of the invention.

Figure 1:
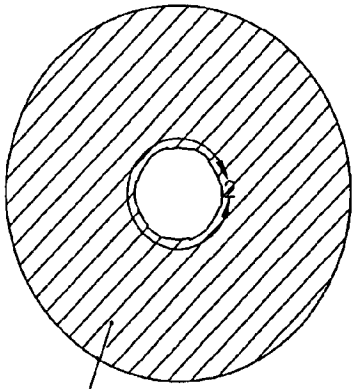
FIG. 1 discloses a cross-section of a first embodiment of a rifle barrel showing the rifling at section 2.

Referring to FIG. 1, FIG. 1 discloses a cross-sectional view of a gun barrel 10A. Section 2 of FIG. 1 illustrates the rifling of the invention and is shown in further detail in FIGS. 2-6. The helix of the rifling providing a twist in the rifled barrel is substantially uniform from the breech end of the barrel to the muzzle end of the barrel.

Figure 2:
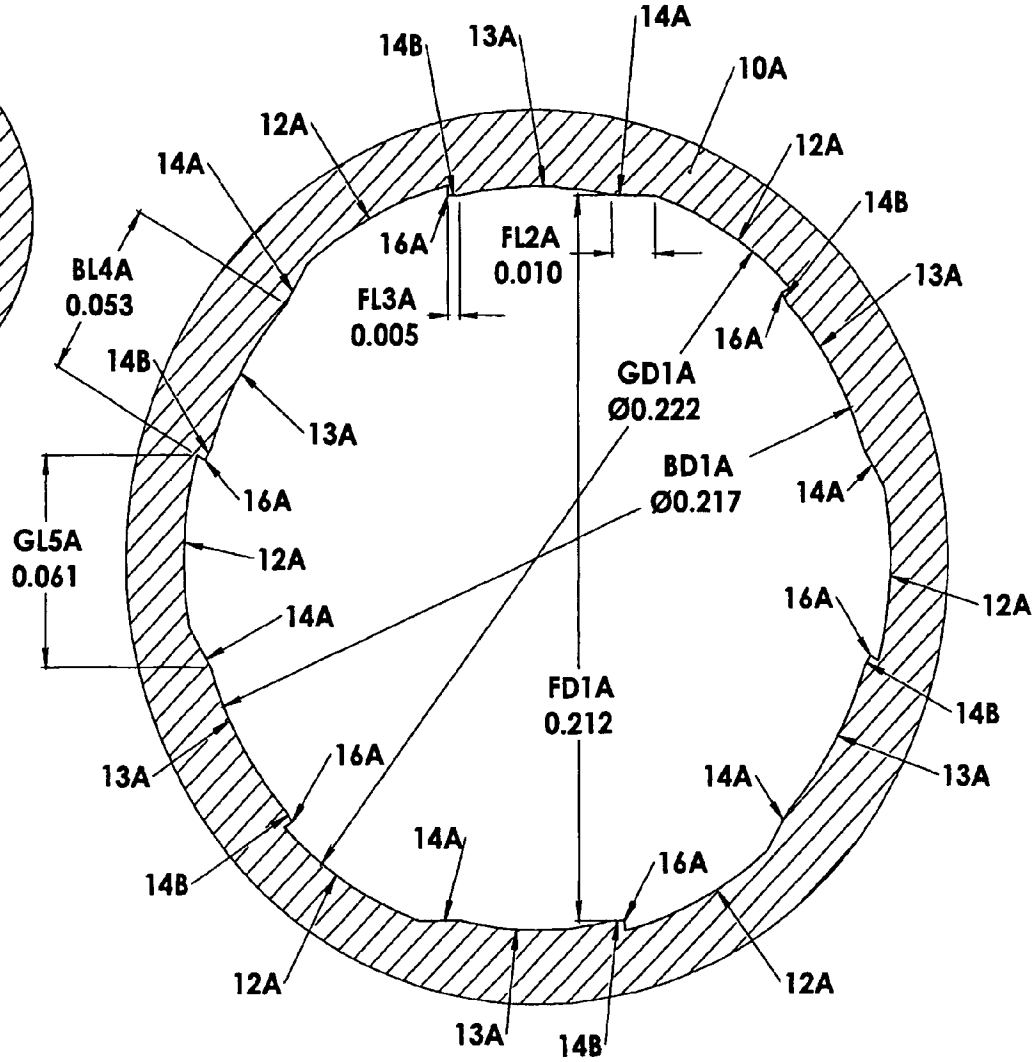
FIG. 2 is a detailed cross-section of the rifling of section 2 of FIG. 1 looking from the muzzle end to the breech end illustrating the grooves and bore of the rifling with a single edge area and a polygonal area therebetween.
Figure 4:
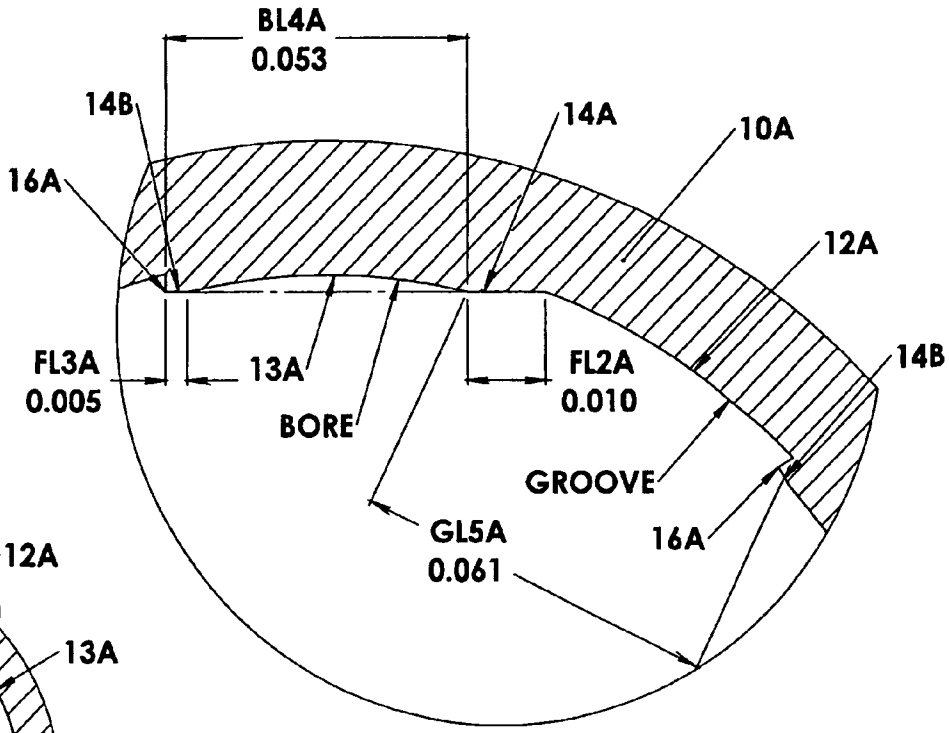
FIG. 4 is an enlarged view of section 4 of FIG. 3 illustrating the rifling of the invention.
Figure 3:
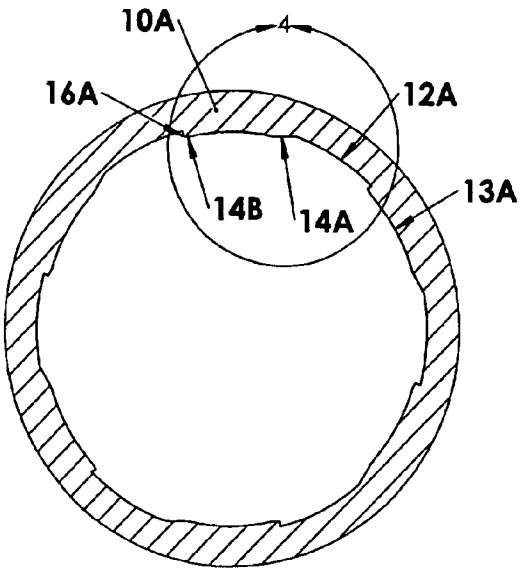
FIG. 3 is a further detailed cross-section of FIG. 1 similar to FIG. 2 illustrating the rifling of the invention.

Referring to FIGS. 2-4, these Figures disclose a cross-section of barrel 10A having rifling including a bore diameter BD1A, a groove diameter GD1A and flat areas 14A and single edge areas 16A joining grooves 12A and bores 13A. There is also a flat area 14B adjacent single edge areas 16A. Specifically, referring to FIG. 2, there is a flat area 14A which transitions between bore 13A and groove 12A. In a preferred embodiment, this flat area has a length FL2A of 0.010 inches. There is a single edge 16A having an angle less than ninety degrees and which transitions between bore 13A and groove 12A. There is also a flat area 14B adjacent single edge area 16A beginning the transition between bore 13A and groove 12*a*. This flat area 14B has a length of FL3A of 0.005 inches and is less than the length of flat area 14A. As apparent, the transition at 14A is more gradual than the transition at single edge area 16A and flat area 14B.

This rifling providing the single edge area 16A and the flat area 14A provides for superior tracking of a bullet in rifles and, in particular, in a 22 caliber rifle using a lead bullet. As shown in FIGS. 2 and 3, there are six grooves 12A, six bores 13A, six flat areas 14A and six single edge areas 16A which also include adjacent, flat areas 14B. However, the number of grooves and bores may vary depending on the type of gun barrel.

Figure 5:
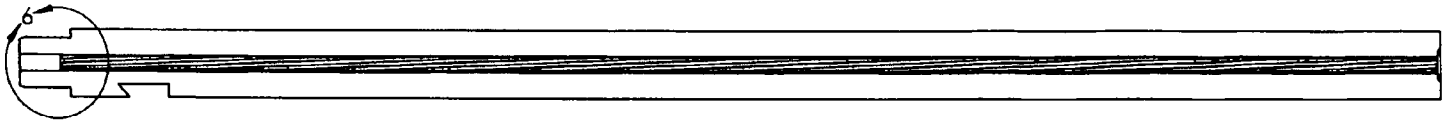
FIG. 5 is a sectional view of a gun barrel with the rifling of FIG. 1 of the invention.
Figure 6:
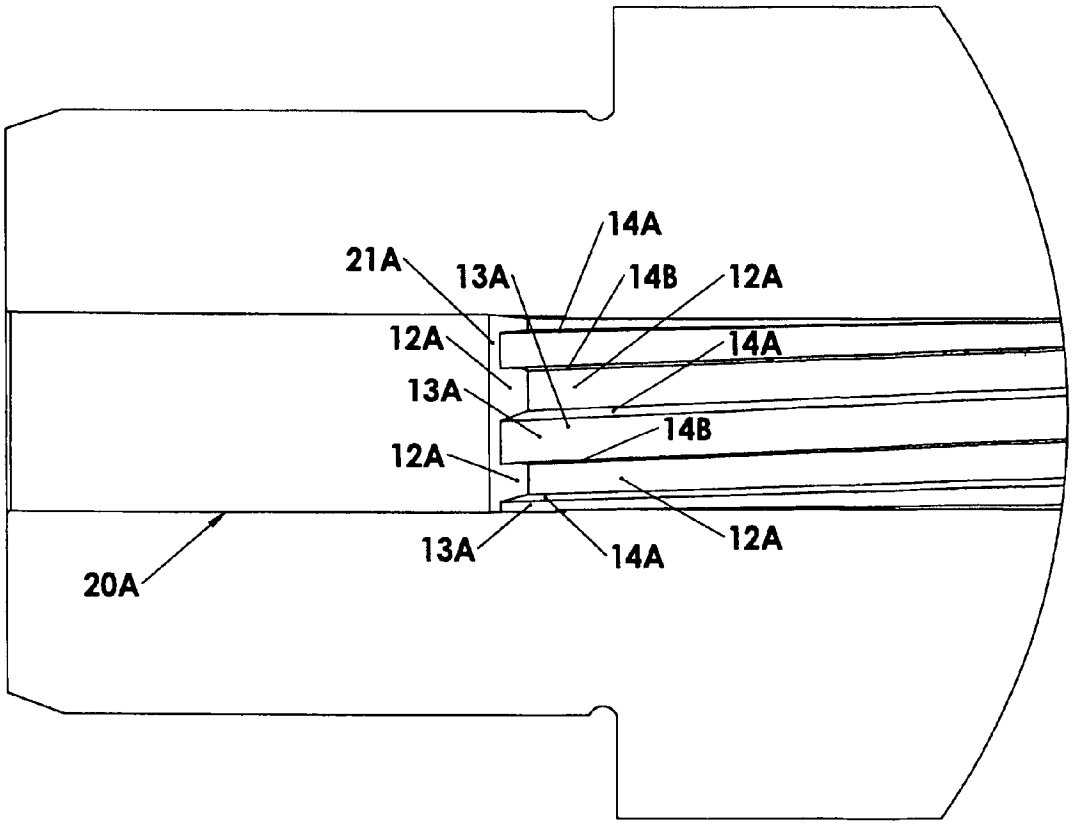
FIG. 6 is an enlarged view of section 6 of FIG. 5 illustrating the breech end of the gun barrel and the rifling of FIG. 1 of the invention.

Again referring to FIGS. 2-4, GD1A shows the groove diameter; BD1A shows the bore diameter; FD1A shows the diameter between a flat area 14A and an opposite flat area 14B adjacent single edge 16A; FL2A shows the length of first flat area 14A; FL3A shows the length of second flat area 14B; BL4A shows the length of the bore area; and GL5A shows the length of the groove area. In a preferred embodiment, these dimensions are as follows:

GD1A=0.222 inches
BD1A=0.217 inches
FD1A=0.212 inches
FL2A=0.010 inches
FL3A=0.005 inches
BL4A=0.053 inches
GL5A=0.061 inches Referring to FIGS. 5 and 6, FIG. 5 shows a cross-section of the gun barrel having the rifling of FIG. 1 with the breech end at section 6. FIG. 6 shows an enlarged view of section 6 of FIG. 5 and the breech end of the barrel. Numeral 20A illustrates the body of the chamber for receiving the bullet, and numeral 21A illustrates the tapered throat of the chamber that leads into the rifling. The rifling of the invention is shown in cross-section; that is bores 13A, grooves 12A and flat areas 14A and 14B.

Figure 7:
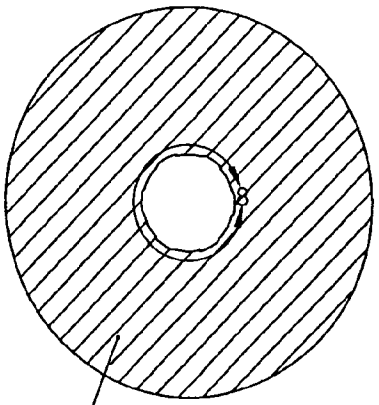
FIG. 7 discloses a cross-section of a second embodiment of a rifle barrel showing the rifling at section 8.

Referring to FIG. 7, FIG. 7 discloses a cross-sectional view of a gun barrel 10B. Section 8 of FIG. 7 illustrates the rifling of the invention and is shown in greater detail in FIGS. 8-12. The helix of the rifling providing a twist in the rifled barrel is substantially uniform from the breech end of the barrel to the muzzle end of the barrel.

Figure 8:
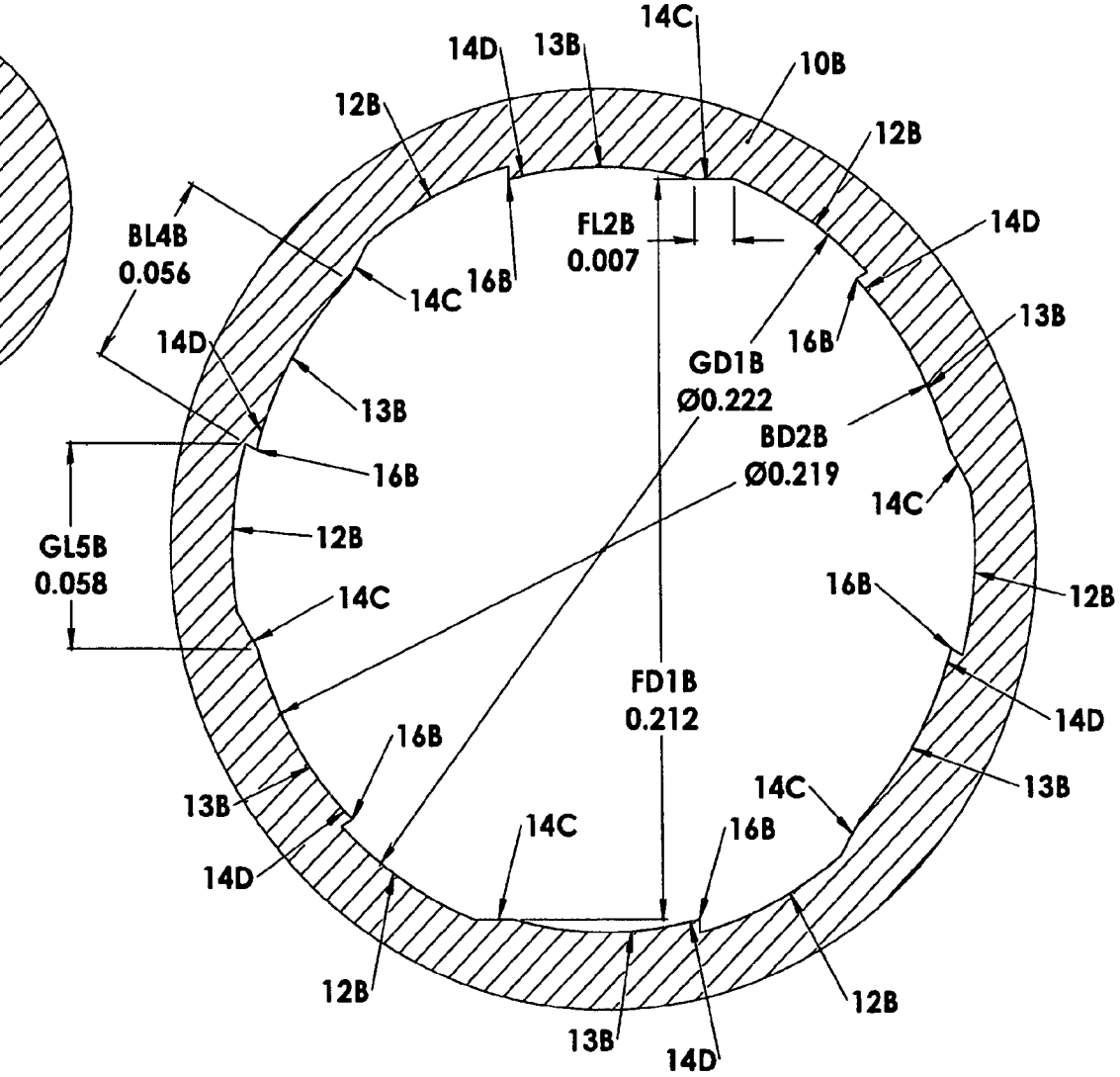
FIG. 8 is a detailed cross-section of the rifling of section 8 of FIG. 7 looking from the muzzle end to the breech end illustrating the grooves and bore of the rifling with a single edge area and a polygonal area therebetween.
Figure 10:
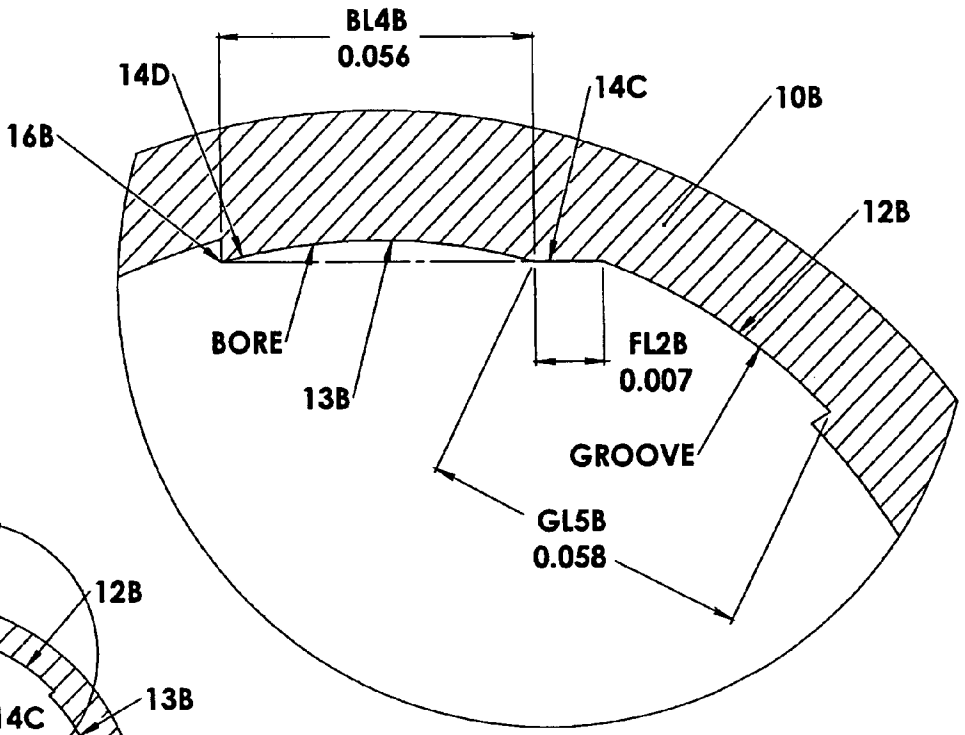
FIG. 10 is an enlarged view of section 10 of FIG. 9 illustrating the rifling of the invention.
Figure 9:
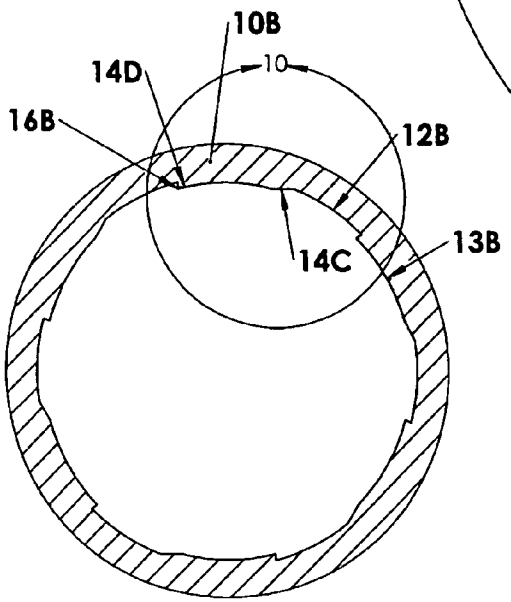
FIG. 9 is a further detailed cross-section of FIG. 7 similar to FIG. 8 illustrating the rifling of the invention.

Referring to FIGS. 8-10, these Figures disclose a cross-section of barrel 10B having rifling including a bore diameter BD2B, a groove diameter GD1B and a flat area 14C joining grooves 12B and bores 13B and a single edge 16B joining bore areas 13B to groove areas 12B. Adjacent single edge area 16B is a non-flat area 14D. Specifically, referring to FIG. 8 there is a flat area 14C which transitions between bore 13B and groove 12B. In a preferred embodiment this flat area 14C has a length FL2B of 0.007 inches. There is a single edge 16B which transitions between bore 13B and groove 12A at a less than ninety degree angle. Adjacent single edge areas 16B are non-flat areas 14D. This rifling having a flat area 14C and a single edge area 16B provides for superior tracking of a bullet in these rifles and, in particular, in a 22 caliber rifle using a lead bullet. As shown in FIGS. 8 and 9, there are six grooves and six bores. However, the number of grooves and bores may vary depending on the type of gun barrel.

Figure 11:
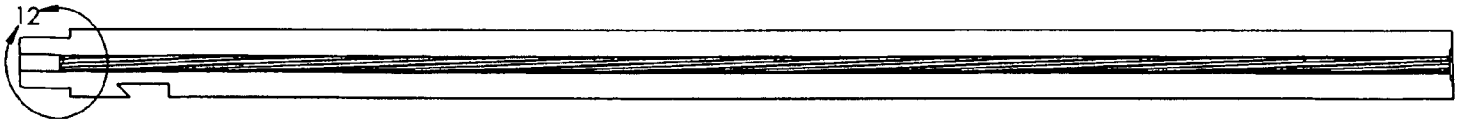
FIG. 11 is a sectional view of a gun barrel with the rifling of FIG. 7 of the invention.
Figure 12:
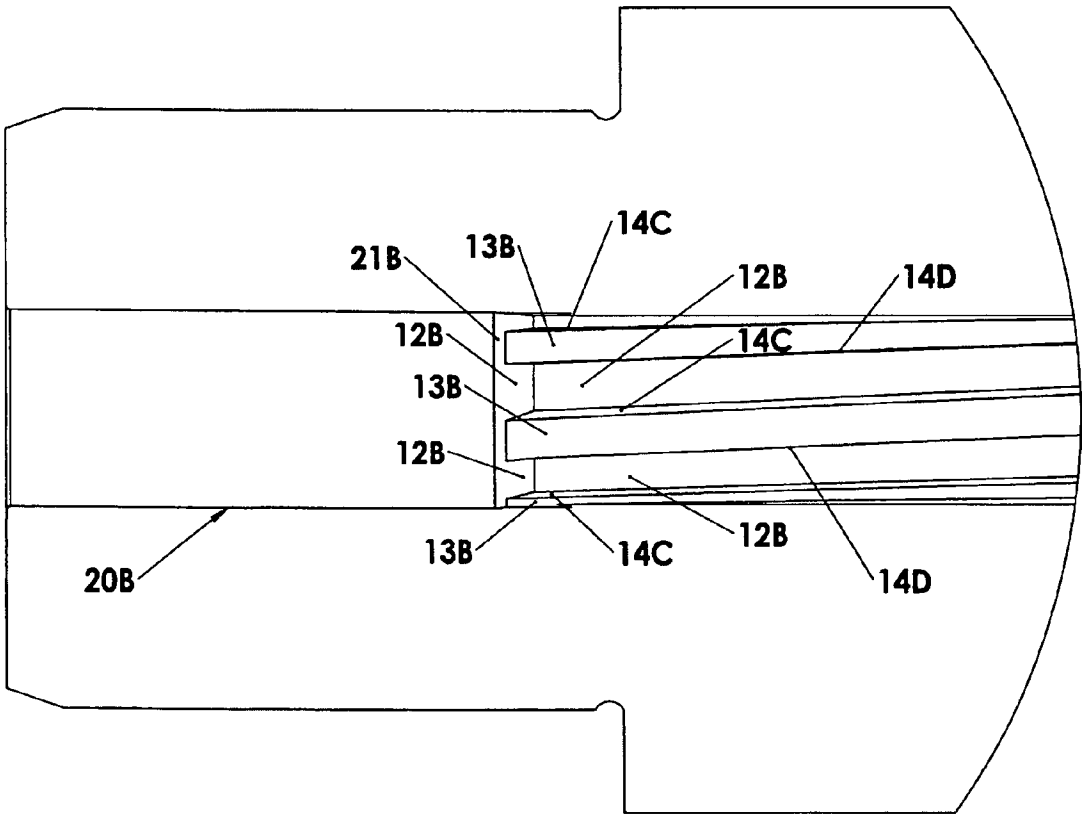
FIG. 12 is an enlarged view of section 12 of FIG. 11 illustrating the breech end of the gun barrel and the rifling of FIG. 7 of the invention.

Again referring to FIGS. 8-10, GD1B shows the groove diameter; BD2B shows the bore diameter; FD1B shows the diameter between a flat area 14C and an opposite non-flat area 14D and adjacent the single edge area 16B; FL2B shows the length of the flat area 14C; BL4B shows the length of the bore area; and GL5B shows the length of the groove area. In a preferred embodiment, these dimensions are as follows:

GD1B=0.222 inches
BD2B=0.219 inches
FD1B=0.212 inches
FL2B=0.007 inches
BL4B=0.056 inches
GL5B=0.058 inches Referring to FIGS. 11 and 12, FIG. 11 shows a cross-section of the gun barrel having the rifling of FIG. 7 with the breech end at section 12. FIG. 12 shows an enlarged view of section 12 of FIG. 11 and the breech end of the barrel. Numeral 20B illustrates the body of the chamber for receiving the bullet, and numeral 21B illustrates the tapered throat of the chamber that leads into the rifling. The rifling of the invention is shown in cross-section; that is bores 13B, grooves 12B, flat areas 14C and non-flat areas 14D adjacent single edge areas 16B (not shown).

With the rifling of the present invention, the bullet gets pushed into the rifling at the throat of the chamber and centers up in the bore. As the bullet is pushed through the barrel at high velocities, with a right hand twist the left side will have a wind up effect and the stress at that corner where the groove meets the bore will not deform the bullet due to single edge area and the flat area between the bore and groove. This is different from standard or polygonal rifling. When, the bullet is fired from the rifle using the rifling of the present invention, the bullet follows the helix angle, e.g. twist rate of the rifling, and the stress from the wind up effect of the bullet creates no or little bullet deformation and provides for more accurate tracking of the bullet when leaving the barrel.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. For example, while the preferred polygonal area separating the grooves and the bore has been described as a flat area, it is understood that this area does not have to be completely flat. Such modifications being within the ability of one skilled in the art form a part of the present invention and are embraced by the appended claim.

It is claimed:

1. A gun barrel having single edge polygonal rifling comprising a series of helically disposed rifling grooves in a barrel bore, said series of rifling grooves having a single edge area and a flat planar area tangential to the bore between said grooves and said bore, and wherein the length of said grooves from said single edge area to said flat planar area tangential to the bore has a constant diameter, wherein said single edge area and said flat planar area tangential to the bore provide a wind up effect to preclude deformation of the bullet.

2. A gun barrel according to claim 1 wherein there are six grooves and six bore areas.

3. A gun barrel according to claim 2 further comprising a flat area adjacent said single edge area.

4. A gun barrel according to claim 1 wherein said flat planar area tangential to the bore transitions gradually from said grooves to said bore.

5. A gun barrel according to claim 4 wherein the length of said flat planar area tangential to the bore is in the range of about 0.005 to about 0.010 inches.

6. A gun barrel according to claim 3 having a groove diameter ("GD1A"), a bore diameter ("BD1A"), a flat planar area tangential to the bore dimension ("FD1A"), a flat planar area tangential to the bore tangential length ("FL1A"), a second flat area tangential length ("FL3A"), a bore area tangential length ("BL4A") and a groove area tangential length ("GL5A"), wherein the dimensions of said gun barrel comprise GD1A=0.222 inches
BD1A=0.217 inches
FD1A=0.212 inches
FL2A=0.010 inches
FL3A=0.005 inches
BL4A=0.053 inches
GL5A=0.061 inches.

7. A gun barrel according to claim 2 further comprising a non-flat area adjacent said single edge area.

8. A gun barrel according to claim 7 having a groove diameter ("GD1B"), a bore diameter ("BD2B"), a flat planar area tangential to the bore dimension ("FD1B"), a flat planar area tangential to the bore tangential length ("FL2B"), a bore area tangential length ("BL4B") and a groove area tangential length ("GL5B"), wherein the dimensions of said gun barrel comprise GD1B=0.222 inches
BD2B=0.219 inches
FD1B=0.212 inches
FL2B=0.007 inches
BL4B=0.056 inches
GL5B=0.058 inches.

9. A gun barrel according to claim 1 wherein the rifling provides a twist in the rifled barrel which is substantially uniform from the breech end of the barrel to the muzzle end of the barrel.

10. A gun barrel according to claim 1 wherein a bullet fired through the barrel will not have any substantial deformation due to the single edge area and the flat area between the bore and grooves.

11. A gun barrel according to claim 1 wherein a bullet fired through the barrel follows the helix angle of the rifling and the stress from the wind up effect of the bullet creates substantially no or little bullet deformation.

* * * * *